US006929262B2

(12) United States Patent
Hostettler

(10) Patent No.: US 6,929,262 B2
(45) Date of Patent: Aug. 16, 2005

(54) SHEET DIVERTING ASSEMBLY

(75) Inventor: Urs Hostettler, Gwatt (CH)

(73) Assignee: De la Rue International Limited, Hampshire (GB)

( * ) Notice: Subject to any disclaimer, the term of this patent is extended or adjusted under 35 U.S.C. 154(b) by 86 days.

(21) Appl. No.: 10/474,051

(22) PCT Filed: Jun. 12, 2002

(86) PCT No.: PCT/GB02/02621

§ 371 (c)(1),
(2), (4) Date: Oct. 6, 2003

(87) PCT Pub. No.: WO02/102696

PCT Pub. Date: Dec. 27, 2002

(65) Prior Publication Data

US 2004/0113359 A1 Jun. 17, 2004

(51) Int. Cl.[7] ..... B65H 39/10
(52) U.S. Cl. ..... 271/304
(58) Field of Search ..... 271/304

(56) References Cited

U.S. PATENT DOCUMENTS 3,472,506 A * 10/1969 Genovese et al. ..... 271/304
4,767,114 A 8/1988 Nishimoto
5,234,211 A * 8/1993 Olexy ..... 271/184

FOREIGN PATENT DOCUMENTS

| | | | |
|---|---|---|---|
| EP | 0 407 151 A2 | 1/1991 | |
| EP | 0 407 151 A2 * | 9/1991 | ..... G03G/15/00 |
| EP | 0 564 291 A2 | 10/1993 | |
| JP | A 8-2775 | 1/1996 | |
| JP | A 2000-143060 | 5/2002 | |

* cited by examiner

*Primary Examiner*—Donald P. Walsh
*Assistant Examiner*—Kenneth W. Bower
(74) *Attorney, Agent, or Firm*—Oliff & Berridge, PLC

(57) ABSTRACT

A sheet diverting assembly comprising at least three sheet access openings (5, 10, 15) through which sheets can be fed; and a rotatable diverting member (2) cooperating with each sheet access opening (5, 10, 15) so as to guide a sheet fed towards the diverting member (2) through one access opening (5, 10, 15) towards one or other of the remaining access openings (5, 10, 15) while rotating in the feed direction. The diverting member (2) includes a plurality of radially extending members (23), the members (23) being sufficiently stiff so as to extend radially outwardly in their rest position but to flex on contact with a sheet as the member (23) rotates.

12 Claims, 5 Drawing Sheets

SHEET DIVERTING ASSEMBLY

The invention relates to a sheet diverting assembly, for example for use in a sheet handling device such as a banknote handler.

Most sheet handling devices require the provision of one or more sheet diverting assemblies which are controlled to feed sheets from an input location to a selected one of a pair of output locations. Conventional diverting assemblies comprise a diverter plate which can pivot between two positions. A disadvantage of such diverter plates is that there is a significant risk of jamming, particularly during high speed operation such as at 20 sheets per second or more which is common with sheet handling devices. U.S. Pat. No. 4,420,153 discloses the use of a rotatable roller having a brush or bristle-like surface and which can be rotated in one of two directions so that an incoming sheet is fed to a corresponding one of a pair of outlets. The problem with this is that a relatively large gap has to be left between the roller and adjacent guide surfaces to prevent the sheets from wrapping around the roller and be fed in the wrong direction but then the sheets will not adequately contact the roller. It is also unable to handle limp sheets.

JP-A-08-002775 illustrates a sheet diverting assembly in which the diverter comprises a rotatably mounted member having a number of radially extending, flexible members.

In accordance with the present invention, a sheet diverting assembly comprises at least three sheet access openings through which sheets can be fed; and a rotatable diverting member cooperating with each sheet access opening so as to guide a sheet, fed towards the diverting member through one access opening, towards one of the remaining access openings while rotating in a first feed direction and towards the other of the remaining access openings while rotating in a second feed direction, wherein the diverting member includes a plurality of radially extending members, the members being sufficiently stiff so as to extend radially outwardly in their rest position but to flex on contact with a sheet as the member rotates, and is characterized in that the apparatus further comprises a guide member coaxial with the diverting member and rotatable therewith, the guide member having a plurality of rigid, radially outwardly projecting teeth, the teeth projecting by a smaller amount than the radially extending members of the diverting member; and in that the assembly further comprises a guide nip cooperating with the radially extending members for guiding a leading edge of a sheet fed through an access opening between the radially extending members so as to engage between adjacent teeth of the guide member.

We have devised a new type of diverting assembly using a special diverting member which enables sheets to be guided via the flexible members which can extend adjacent the corresponding guide surfaces without interfering with the sheets. In fact, it has been found that the invention can divert a multiplicity of different types of sheets and sheet conditions. For example, not only can single sheets such as mint banknotes be accurately guided but so also can torn sheets, relatively limp sheets and multiple sheet packs. The use of flexible members allows them to be interleaved with guide surfaces so as to control the movement of sheets accurately without damaging the sheets. Preferred flexible members are in the form of flexible, plastic vanes having a radial length to thickness ratio of at least 10:1, preferably 20:1.

The divert process is assisted in the preferred case when the assembly further comprises a rotatable guide member having a plurality of rigid, radially outwardly projecting teeth, the teeth projecting by a smaller amount than the radially extending members of the diverting member. The leading end of an incoming sheet will be received between a pair of the rigid teeth which will ensure that the leading end of the sheet is initially guided towards the correct access opening, the flexible members subsequently assisting in the guiding process.

In some applications, one access opening will be solely used to receive sheets while the other access openings will be provided to allow sheets to pass out from the diverting assembly. The assembly can also be used, however, in a configuration in which one or more of the access openings can both receive and dispense sheets. In an important embodiment in this connection, the access openings may be arranged such that the path between two of the openings is substantially linear. This is important in the case where limp or otherwise difficult to handle sheets must be fed through the diverting assembly since these sheets do not respond well to being bent during their transport.

In some examples, one or more diverting members, each including a plurality of radially extending members, could be provided, typically concentrically on a common shaft. Typically, where a rotatable guide member is provided, there will be more rigid teeth on the further rotatable guide member than there are radially extending flexible members although this is not essential.

In a further alternative, when a rotatable guide member is provided, the radially inner ends of the radially extending members could be substantially rigid so as to provide a combined set of teeth and flexible members.

In order to further assist the passage of sheets through the diverting assembly, the assembly may comprise a movable drive surface extending alongside at least one path between the access openings. This drive surface could be constituted by a movable belt, roller or the like.

In most examples, three access openings will be provided but the assembly could be have four or more access openings.

The radially extending members can take a variety of forms. In the preferred form, they comprise vanes, typically of a plastics material, such as mylar, but could alternatively be provided by a set of brushes or the like.

As mentioned above, sheet diverting assemblies according to the invention can be used in a wide variety of sheet handling devices. They find particular use in sheet recirculators such as banknote recirculators, sheet sorters such as banknote sorters and the like.

Some examples of sheet diverting assemblies according to the invention will now be described with reference to the accompanying drawings, in which.

Figure 1:
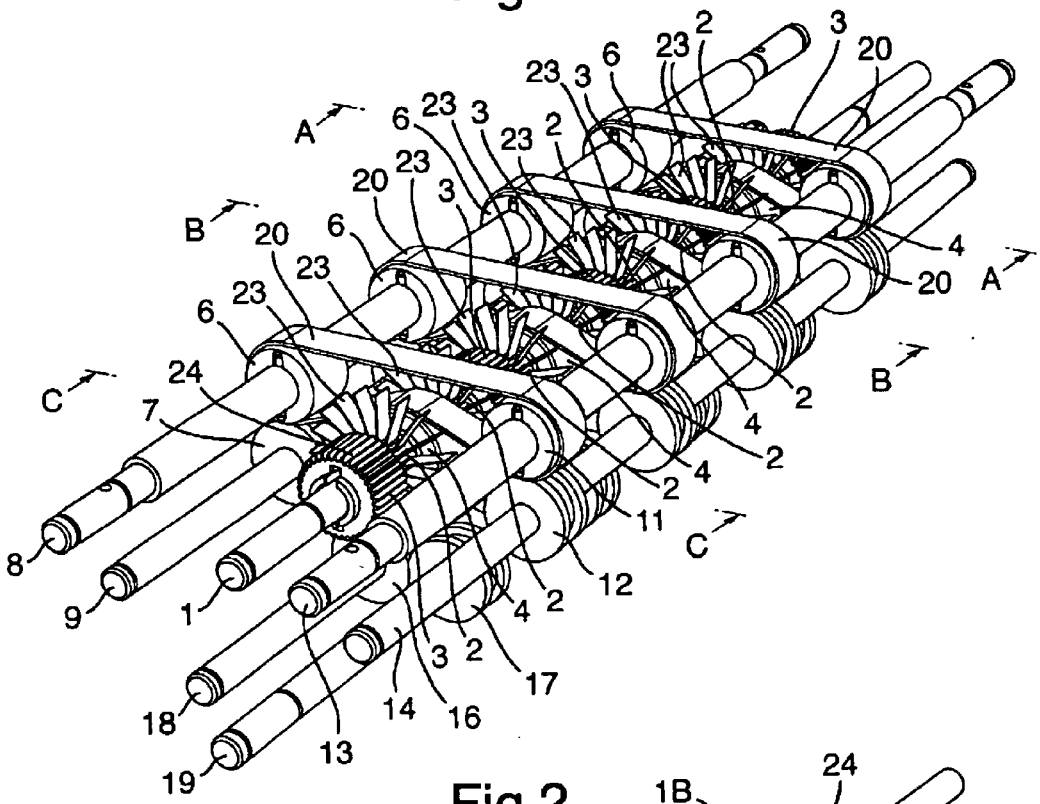
FIG. 1 is a perspective view of a first example of the assembly with guide surfaces omitted for clarity.
Figure 2:
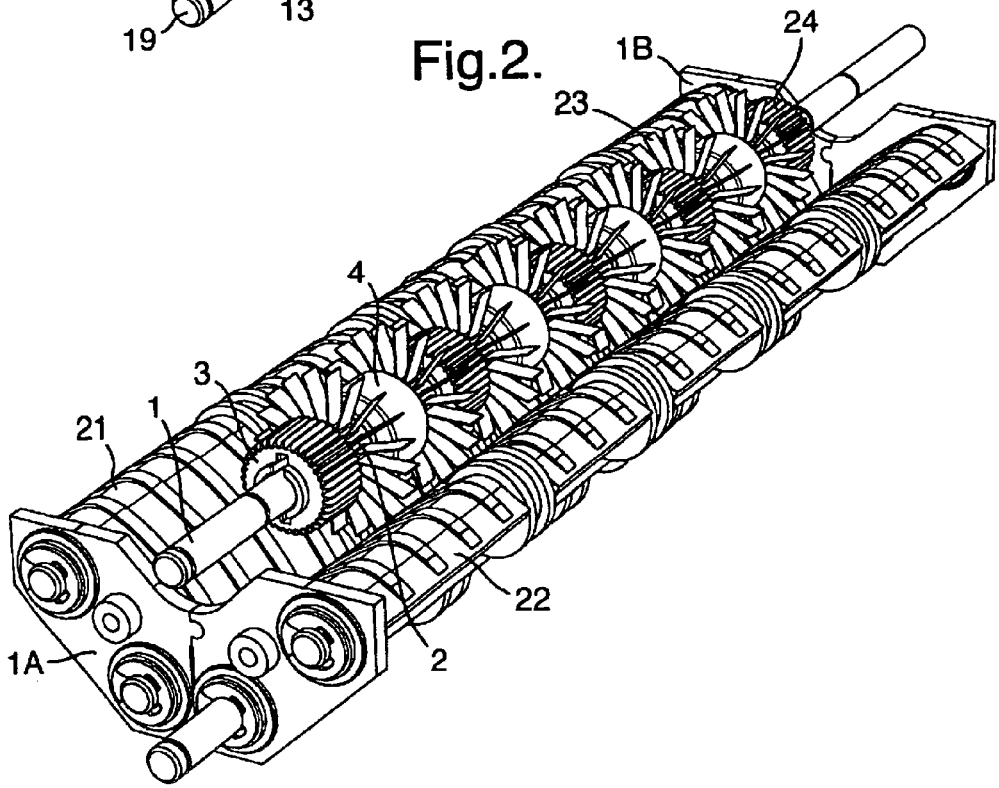
FIG. 2 is a view similar to FIG. 1 but showing the lower part of the assembly and also the guide surfaces.

The sheet diverting assembly shown in FIGS. 1 and 2 comprises a shaft 1 on which are mounted, non-rotatably, eight vaned rollers 2, and five toothed rollers 3 while four pulleys 4 are rotatably mounted to the shaft 1. The shaft 1 is mounted in bearings (not shown) in side plates (also not shown) of the note handling device in which the sheet diverting assembly is located. A first access opening 5 is defined between pairs of upper and lower rollers 6,7 non-rotatably mounted on respective shafts 8,9 supported via bearings in end plates 1A,1B. This can be seen more clearly in FIGS. 3 and 4.

A second access opening 10 is formed between pairs of upper and lower rollers 11,12 non-rotatably mounted on respective shafts 13,14.

Finally, a third access opening 15 is formed between pairs of rollers 16,17 non-rotatably mounted on respective shafts 18,19.

The passage between access openings 5,10 is connected via belts 20 entrained around rollers 6,11 and over pulleys 4 although other guide surfaces could be used.

As can be seen in FIG. 2, a pair of guide surfaces 21,22 are also provided linking the access openings 5,10 respectively with the access opening 15. A guide surface 21A links access openings 5,10 (FIG. 3).

The diverting assembly shown in FIGS. 1 to 4 can be operated so that a sheet arriving at any one of the access openings 5,10,15 can be fed to either of the remaining two access openings.

Figure 3A:
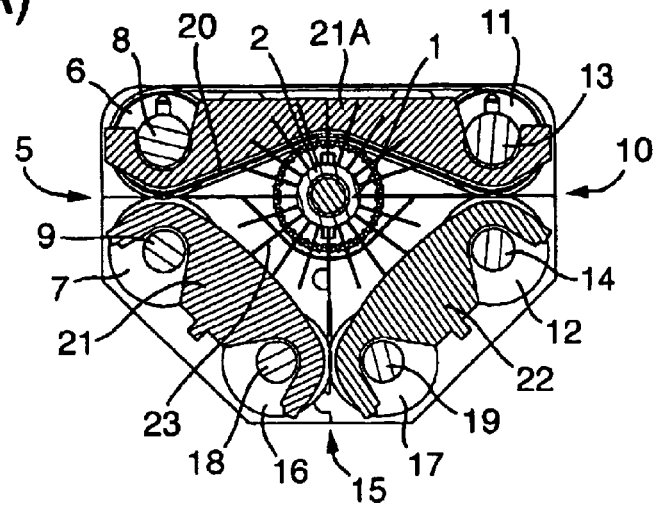
FIGS. 3A–3C are sections taken on the lines A—A, B—B and C—C respectively in FIG. 1 but with the guide surfaces included.
Figure 3B:
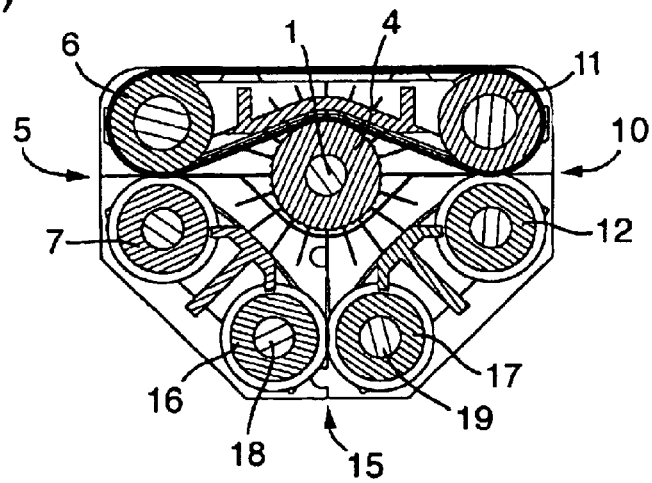
Figure 3C:
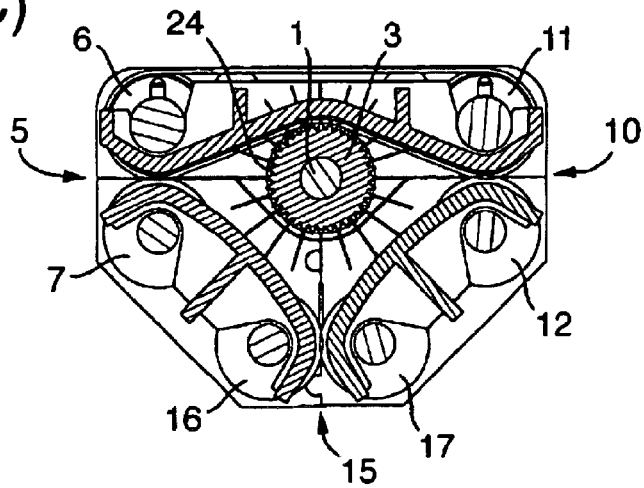
Figure 4:
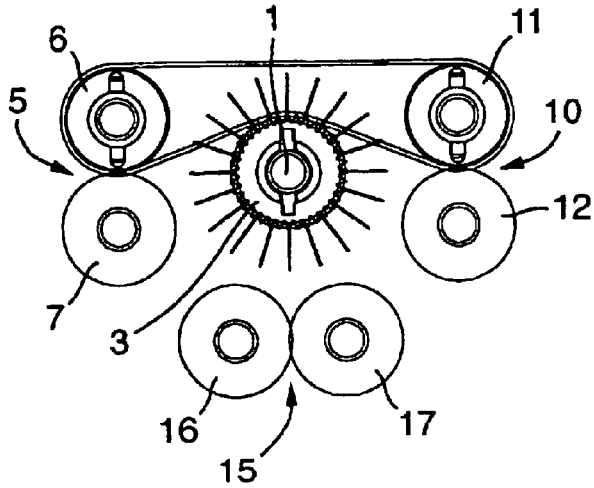
FIG. 4 is a section taken on the line C—C but with the guide surfaces omitted.

For example, if a sheet arriving at the access opening 15 is to be diverted to the access opening 10 then the rollers 17,12 are rotated in a clockwise direction (as seen in FIG. 3) by suitably rotating the shafts 19,14 while the rollers 11 are rotated in an anti-clockwise direction by anti-clockwise rotation of the shaft 13. The shaft 1 is also rotated in an anti-clockwise direction and thereby rotates the rollers 2,3 in an anti-clockwise direction also. The leading edge of the incoming sheet is fed through the nip between the rollers 16,17 and will pass between adjacent pairs of vanes 23 on each of the rollers 2 and engage between a pair of the rigid teeth 24 on the rollers 3. Rotation of the rollers 3 will initially guide the leading edge of the sheet towards the access opening 10. It will then be released from these teeth 24 and be pushed towards the access opening 10 under the influence of the vanes 23 until it enters the nips between the rollers 11,12.

The diverting of a sheet from the access opening 15 to the access opening 5 will occur in a similar manner with the shaft 1 being rotated in the opposite direction.

Further, in a similar manner, sheets can be guided from either of the access openings 5,10 to the access opening 15 by reversing the rotation of the appropriate shafts.

Finally, sheets can be guided between the access openings 5,10 by suitably rotating the shaft 1 in the appropriate direction. Movement between these access openings is assisted, in this example, by the belts 20 and it will also be noted that this path is substantially linear as compared with the paths between the access openings 5,10 on the one hand and the access opening 15 on the other hand. This substantially linear path can be utilized for relatively limp sheets.

Figure 5A:
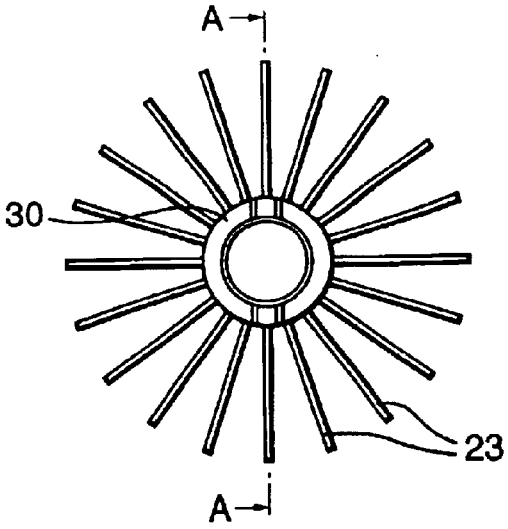
FIGS. 5A–5C are an end elevation, a section on the line A—A in FIG. 5A, and an enlarged view of the section B in FIG. 5A respectively, of a vane roller.
Figure 5B:
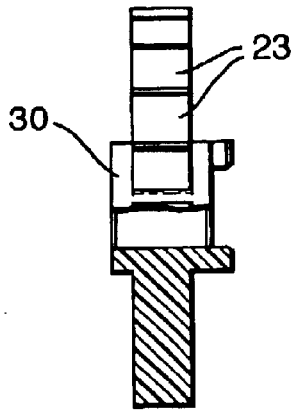
Figure 5C:
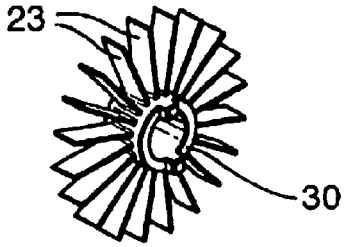

The construction of one of the vaned rollers 2 is shown in more detail in FIG. 5. As can be seen, this is typically a plastics moulding made of mylar or the like having a central hub 30 and a number, in this case 20, radially extending and substantially equally circumferentially spaced vanes 23. The dimensions of each vane 23 can be seen in FIGS. 5A and 5B. The vanes extend between or are interleaved between adjacent pairs of belts 20 defining guide surfaces. When a note is received between adjacent vanes and the roller rotates, the vanes will flex and urge the note against the belts 20. Once a note has been removed, the vanes will return to their unflexed position.

Figure 6A:
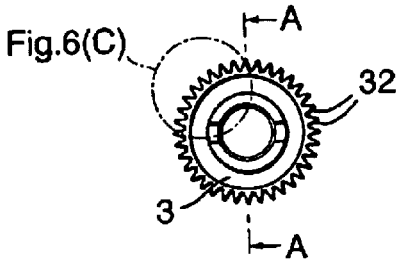
FIGS. 6A–6C are an end elevation, section on the line A—A in FIG. 6A and an enlarged view of the portion B in FIG. 6A respectively.
Figure 6B:
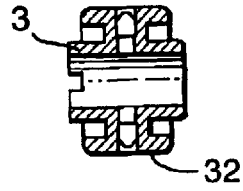
Figure 6C:
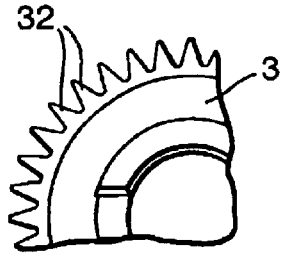

FIG. 6 illustrates the construction of one of the toothed rollers 3 and as can be seen this has a relatively large number of radially extending teeth 32 greater than the number of vanes 23 but of a much shorter radial extent. The dimensions of these teeth can be seen in FIGS. 6B and 6C. In both FIGS. 5 and 6, all dimensions are shown in millimetres.

Figure 7:
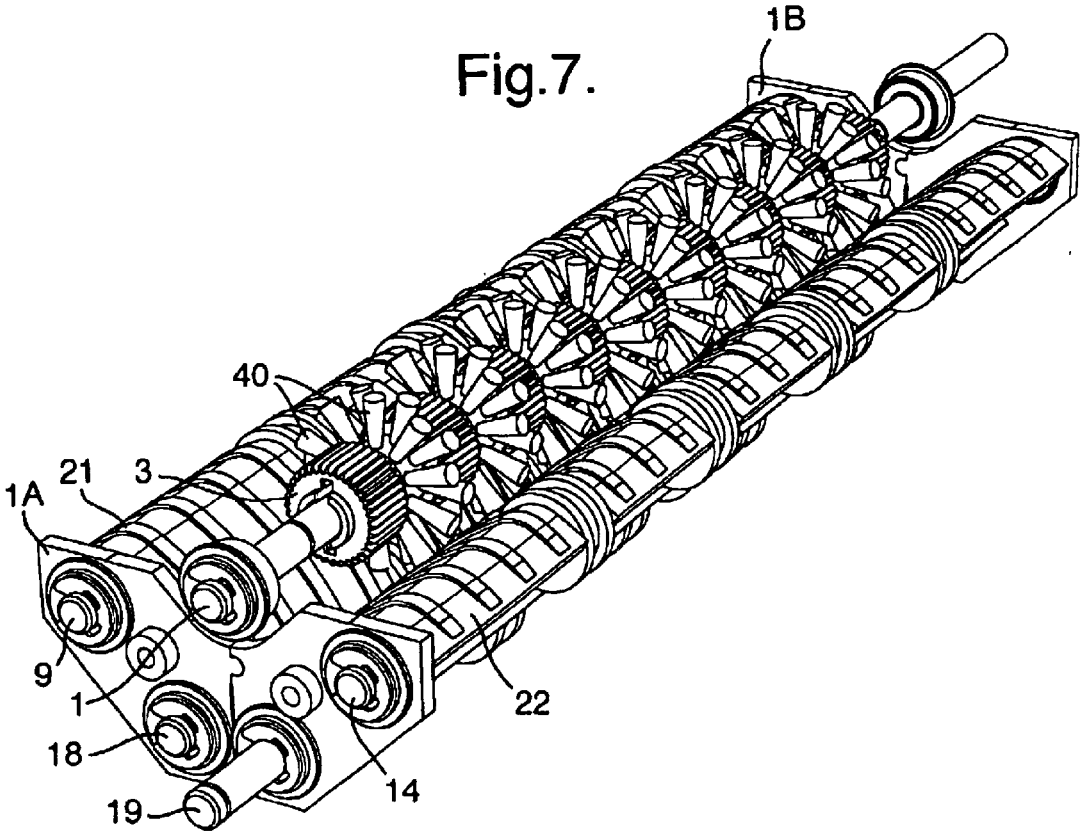
FIG. 7 is a view similar to FIG. 2 but of a second example.

FIG. 7 is a view similar to FIG. 2 but showing a modified example in which the vanes 23 are replaced by plastic, brush-like elements 40 and the pulleys 4 are omitted. Each brush-like element 40 is made up of a large number of individual fibres (not shown in FIG. 7) and as can be seen in FIG. 7, the brush-like members 40 are arranged in two circumferential sets with the brushes of one set circumferentially offset from those of the other set.

Figure 8:
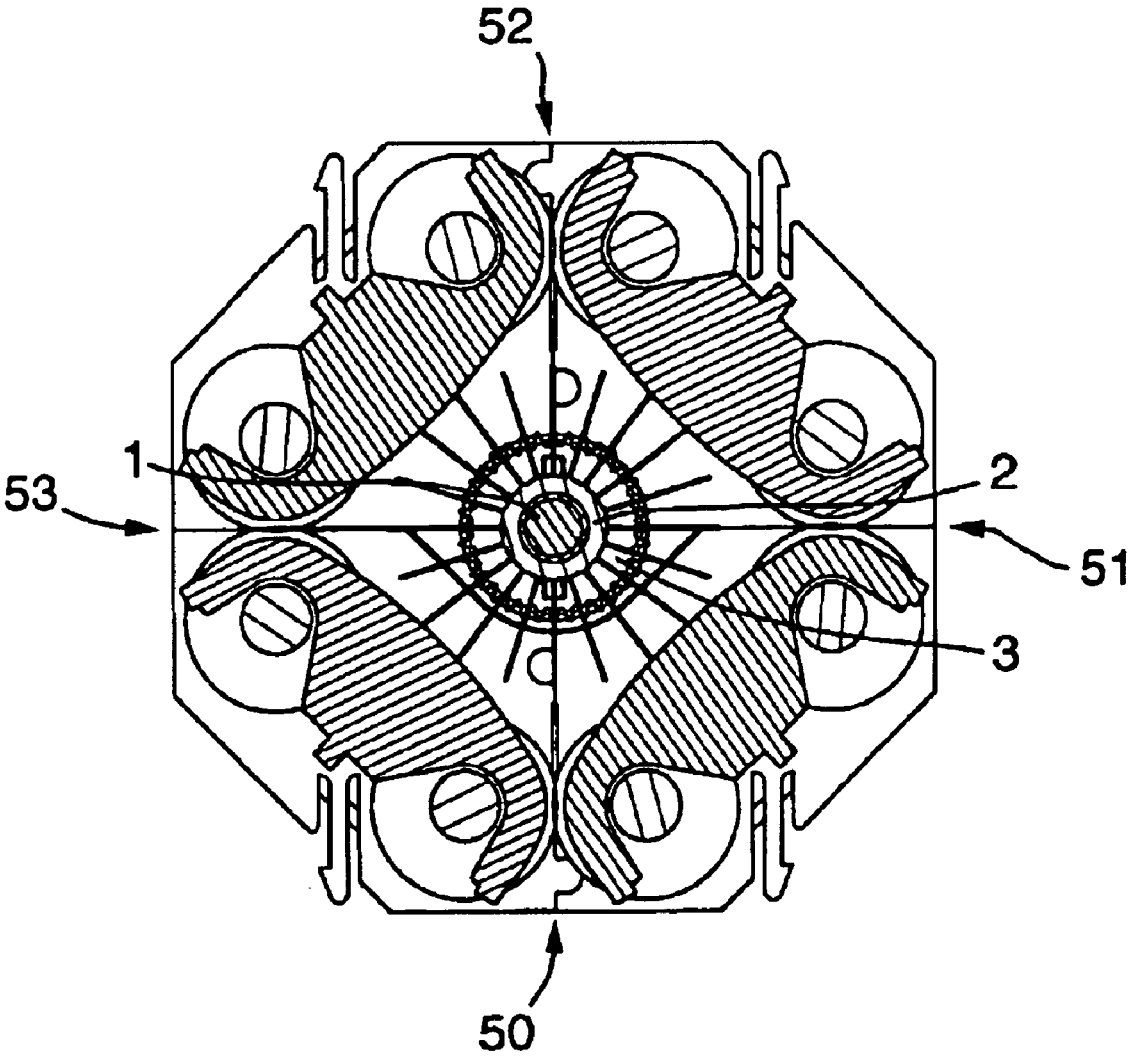
FIG. 8 is a view similar to FIG. 3 but of a further example.

The diverting assemblies described above have three access openings. FIG. 8 illustrates an example of a four access opening assembly. The access openings are indicated at 50–53 respectively. The other components are substantially the same as shown in FIG. 3 and will not be described in further detail. It will be understood that a sheet arriving at any one of the access openings 50–53 can be diverted to one of the two adjacent access openings upon suitable rotation of the shaft 1.

What is claimed is:

1. A sheet diverting assembly comprising at least three sheet access openings through which sheets can be fed; and a rotatable diverting member cooperating with each sheet access opening so as to guide a sheet, fed towards the diverting member through one access opening, towards one of the remaining access openings while rotating in a first feed direction and towards the other of the remaining access openings while rotating in a second feed direction, wherein the diverting member includes a plurality of radially extending members the members being sufficiently stiff so as to extend radially outwardly in their rest position but to flex on contact with a sheet as the member rotates, characterized in that the apparatus further comprises a guide member coaxial with the diverting member and rotatable therewith, the guide member having a plurality of rigid, radially outwardly projecting teeth the teeth projecting by a smaller amount than the radially extending members of the diverting member; and in that the assembly further comprises a drive nip cooperating with the radially extending members for guiding a leading edge of a sheet fed through an access opening between the radially extending members so as to engage between adjacent teeth of the guide member.

2. An assembly according to claim 1, wherein the radially extending members comprise vanes.

3. An assembly according to claim 1, wherein the radially extending members comprise brushes.

4. An assembly according to claim 1, wherein the radially extending members have a radial length to thickness ratio of at least 10:1, preferably 20:1.

5. An assembly according to claim 1, wherein the radially extending members are interleaved between laterally spaced guide surfaces extending between the access openings.

6. An assembly according to claim 1, wherein a plurality of sets of radially outwardly projecting rigid teeth are provided laterally spaced apart with radially extending members interleaved between the sets.

7. An assembly according to claim 6, wherein the number of teeth on the rotatable guide member is greater than the number of radially extending members on the diverting member.

8. An assembly according to claim 6, wherein the rotatable guide member is laterally offset from the rotatable diverting member.

9. Apparatus according to claim 1, wherein two of the access openings communicate via a linear path.

10. An assembly according to claim 1, further comprising a drive surface extending alongside at least one path between a pair of access openings.

11. An assembly according to claim 10, wherein the drive surface is defined by a drive belt.

12. An assembly according to claim 1, wherein the guide means comprises, at each access opening, a pair of feed rollers defining a feed nip.

* * * * *